US008863443B2

(12) United States Patent
Dalo

(10) Patent No.: US 8,863,443 B2
(45) Date of Patent: Oct. 21, 2014

(54) LIGHTWEIGHT HOUSING MODULE AND MODULAR BUILDING

(75) Inventor: Catherine Dalo, Saint Martin de Nigelles (FR)

(73) Assignee: Catherine Dalo, Saint Martin de Nigelles (FR)

( * ) Notice: Subject to any disclaimer, the term of this patent is extended or adjusted under 35 U.S.C. 154(b) by 223 days.

(21) Appl. No.: 13/072,200

(22) Filed: Mar. 25, 2011

(65) Prior Publication Data

US 2011/0258941 A1 Oct. 27, 2011

(30) Foreign Application Priority Data

Mar. 26, 2010 (FR) ..... 10 01236

(51) Int. Cl.

| | |
|---|---|
| ***E04B 7/00*** | (2006.01) |
| ***E04H 15/18*** | (2006.01) |
| ***E04B 1/32*** | (2006.01) |
| ***E04H 15/26*** | (2006.01) |
| ***E04H 15/34*** | (2006.01) |
| ***E04H 15/42*** | (2006.01) |
| ***E04B 7/14*** | (2006.01) |
| ***E04H 1/12*** | (2006.01) |
| ***E04B 1/343*** | (2006.01) |
| *E04B 1/76* | (2006.01) |

(52) U.S. Cl.

CPC *E04H 15/18* (2013.01); *E04B 7/14* (2013.01); *E04H 1/1205* (2013.01); *E04B 1/34315* (2013.01); *E04B 1/76* (2013.01); *Y10S 135/908* (2013.01)

USPC ..... 52/63; 52/22; 52/80.1; 135/99; 135/123; 135/156; 135/159; 135/908

(58) Field of Classification Search

CPC ..... E04H 15/18; E04H 15/26; E04H 15/32; E04H 15/322; E04H 15/36; E04H 15/40; E04B 7/14

USPC ..... 52/22, 63, 80.1, 82, 83, 127.2, 222; 135/121, 123, 99, 124, 156, 159, 908

See application file for complete search history.

(56) References Cited

U.S. PATENT DOCUMENTS

| | | | |
|---|---|---|---|
| 214,996 | A | 5/1879 | Doane |
| 1,262,564 | A | 4/1918 | Reynolds |

(Continued)

FOREIGN PATENT DOCUMENTS

| | | | |
|---|---|---|---|
| DE | 1434570 | A1 | 10/1969 |
| DE | 29600145 | U1 | 4/1997 |

(Continued)

OTHER PUBLICATIONS

Preliminary Search Report of FR10/01236; Jan. 12, 2011; Zuurveld, Gerben.

(Continued)

*Primary Examiner* — Ryan Kwiecinski
(74) *Attorney, Agent, or Firm* — BCF LLP

(57) ABSTRACT

This invention relates to a lightweight housing module comprising at least one stretched fabric intended to form the roof of said module and fixed along its lower edge on a rigid frame maintained at a distance from the ground by a plurality of lateral posts, remarkable in that it comprises vertical panels and/or opening frames in order to close in a substantially sealed manner its vertical facades and a false ceiling arranged in order to be arranged under said fabric inside said lightweight housing module and fixed to the frame. This invention also relates to a modular building remarkable in that it comprises a plurality of lightweight housing modules, according to the invention, arranged next to one another, and a system for sealing between the adjacent lightweight housing modules. This invention also relates to their method of assembly.

24 Claims, 6 Drawing Sheets

(56) References Cited

U.S. PATENT DOCUMENTS

| | | | | |
|---|---|---|---|---|
| 1,428,139 | A | 9/1922 | Brown | |
| 1,900,274 | A | 3/1933 | Brockie | |
| RE26,121 | E | 12/1966 | Wiegand | |
| 3,338,000 | A | 8/1967 | Ostrander et al. | |
| 3,521,416 | A | 7/1970 | Joor | |
| 3,660,953 | A * | 5/1972 | Schenk | 52/82 |
| 3,896,830 | A * | 7/1975 | Sharick | 135/93 |
| 3,906,685 | A | 9/1975 | Howard | |
| 3,945,106 | A | 3/1976 | Mayr et al. | |
| 4,763,452 | A | 8/1988 | Harvey | |
| 4,901,484 | A * | 2/1990 | Santosuosso | 52/93.1 |
| 5,076,031 | A | 12/1991 | Hancock | |
| 5,140,788 | A * | 8/1992 | Lynch | 52/63 |
| 5,522,186 | A * | 6/1996 | Jarman | 52/73 |
| 6,279,284 | B1 * | 8/2001 | Moras | 52/408 |
| 6,345,638 | B1 * | 2/2002 | Warner | 135/123 |
| 6,789,978 | B1 | 9/2004 | Yoshinari | |
| 7,314,055 | B2 | 1/2008 | Guo et al. | |
| 7,845,121 | B2 * | 12/2010 | Wobben | 52/173.1 |
| 2006/0283103 | A1 * | 12/2006 | Chen | 52/63 |
| 2008/0022609 | A1 * | 1/2008 | Franco et al. | 52/83 |
| 2009/0071080 | A1 * | 3/2009 | Bourgain et al. | 52/63 |
| 2010/0243014 | A1 * | 9/2010 | Shires | 135/124 |
| 2011/0259383 | A1 * | 10/2011 | Dalo | 135/128 |

FOREIGN PATENT DOCUMENTS

| | | | |
|---|---|---|---|
| EP | 467867 | A1 | 1/1992 |
| EP | 0277073 | B1 | 6/1992 |
| EP | 0908570 | A1 | 4/1999 |
| EP | 1712709 | A1 | 10/2006 |
| EP | 1905926 | A1 | 4/2008 |
| EP | 1932983 | A1 | 6/2008 |
| EP | 2130994 | A1 | 12/2009 |
| FR | 799306 | A | 6/1936 |
| FR | 2578281 | A1 | 9/1986 |
| FR | 2666612 | A1 | 3/1995 |
| FR | 2691495 | B1 | 5/1996 |
| FR | 2684712 | B1 | 9/1998 |
| FR | 2770864 | A1 | 5/1999 |
| FR | 2955135 | A1 | 7/2011 |
| JP | 04289390 | A | 10/1992 |
| WO | 9221843 | A1 | 12/1992 |

OTHER PUBLICATIONS

English abstract of EP 0908570, Mar. 25, 2011.
English abstract of FR 2770864, Mar. 25, 2011.
English abstract of EP 1712709, Mar. 25, 2011.
English abstract of EP 2 130 994 retrieved from Espacenet on May 3, 2013.
English abstract of EP 0 277 073 retrieved from Espacenet on May 3, 2013.
English abstract of FR 2 684 712 retrieved from Espacenet on May 3, 2013.
English abstract of EP 1 905 926 retrieved from Espacenet on May 3, 2013.
English abstract of FR 2 955 135 retrieved from Espacenet on May 3, 2013.
Preliminary Search Report of FR 10/01238; Jan. 14, 2011; Delzor Francois.
English Abstract of EP 1932983 retrieved from Espacenet on Mar. 24, 2011.
English Abstract of FR 2578281 retrieved from Espacenet on Apr. 7, 2014.
English Abstract of FR 2666612 retrieved from Espacenet on Apr. 7, 2014.
English Abstract of JP04289390 retrieved from Espacenet on Apr. 7, 2014.
English Abstract of FR 2691495 retrieved from Espacenet on Apr. 7, 2014.

* cited by examiner

LIGHTWEIGHT HOUSING MODULE AND MODULAR BUILDING

TECHNICAL FIELD

This invention relates to a lightweight housing module and a modular building constituted of a plurality of lightweight housing modules, as well as their respective method of assembly.

PRIOR ART

Lightweight housing modules are already known comprising a stretched fabric intended to form the roof of said module and conventionally fixed along its lower peripheral edge on a rigid frame maintained at a distance from the ground by a plurality of lateral posts which in turn are fixed on the ground. Said fabric can then be stretched by fixing its central portion to the upper end of a central mast then by pulling on the lower edge of said fabric via suitable means. The fabric can also be stretched by at least one arch subdivided into two semi-arches of which the lower ends each press against the rigid frame, and of which the upper ends are connected to one another by a device making it possible to separate said upper ends from one another in order to obtain, on the one hand, the upward deformation via buckling of said arch and, on the other hand, the stretching of the fabric. The vertical faces coming from the periphery of the rigid frame are then closed by plates or opaque, transparent or translucent fabric in order to obtain a lightweight housing module. These modules are easy to implement as they do not require tools or complicated equipment, or highly-qualified personnel. However, this type de module is not economical as they have a high operating cost especially for heating. Indeed, these lightweight modules have a high thermal permeability.

In the field of housing modules, many prefabricated constructions are already known such as for example the Algeco Modules (Registered trademark) carried out most of the time using a metal structure. These modular constructions, at road gauge are installed alone or assembled, temporarily or definitively and are commonly used as a construction camp, offices, or technical premises.

However, the standardization of these housing modules substantially limits the fantasy of the creation and, therefore, is not used for constructions that are intended to be, if not original, at least unique.

Furthermore, these modules are in principle prefabricated and therefore of substantial dimensions and weight. Consequently, they require, on the one hand, a semi-trailer truck for their road transport and, on the other hand, high-capacity hoisting equipment for their loading and unloading. Said modules are therefore not suited to installations on sites that are difficult to access.

DESCRIPTION OF THE INVENTION

The purpose of this invention is therefore to overcome the aforementioned disadvantages and to propose a lightweight housing module and a modular building constituted of a plurality of lightweight housing modules, each having high thermal insulation characteristics and being particularly simple to implement without having to call upon any high-capacity hoisting equipment.

In accordance with the invention, it is therefore proposed a lightweight housing module comprising at least one stretched fabric intended to form the roof of said lightweight housing module and intended to be fixed along its lower peripheral edge on a rigid frame maintained at a distance from the ground by a plurality of lateral posts which are in turn intended to be fixed on the ground, remarkable in that it comprises a system for stretching said fabric arranged to be arranged entirely inside said lightweight housing module and able to stretch said fabric by pushing it upwards, vertical panels and/or opening frames in order to close in a substantially sealed manner the vertical facades located along the perimeter of said frame and a false ceiling arranged in order to be arranged under said fabric inside said lightweight housing module and fixed by its peripheral edge to the frame in such a way as to create a "heat and sound cushion" by imprisoning the air contained between the fabric and said false ceiling.

This invention further relates to a modular building remarkable in that it comprises a plurality of lightweight housing modules, according to the invention, arranged next to one another, and a system for sealing provided between the faces across from the frames of two adjacent lightweight housing modules, said system for sealing providing the seal for the unit of said modular building.

The lightweight housing modules according to the invention are arranged in such a way that they make it possible to obtain a modular building of varied shapes and dimensions.

SUMMARY DESCRIPTION OF THE FIGURES

Other advantages and characteristics will become clearer after reading the following description of an alternative embodiment of a lightweight housing module and of a modular building according to the invention in reference to the annexed figures wherein.

Figure 9:
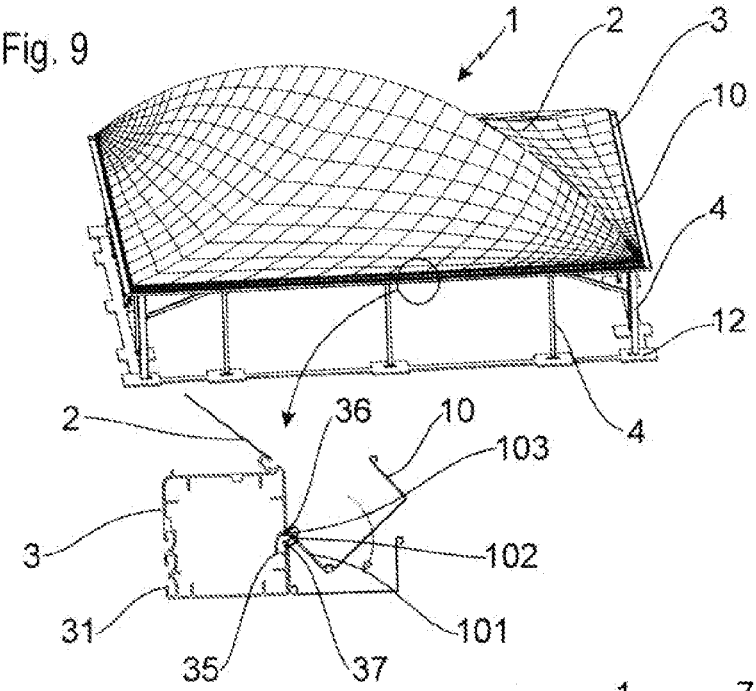
Figure 10:
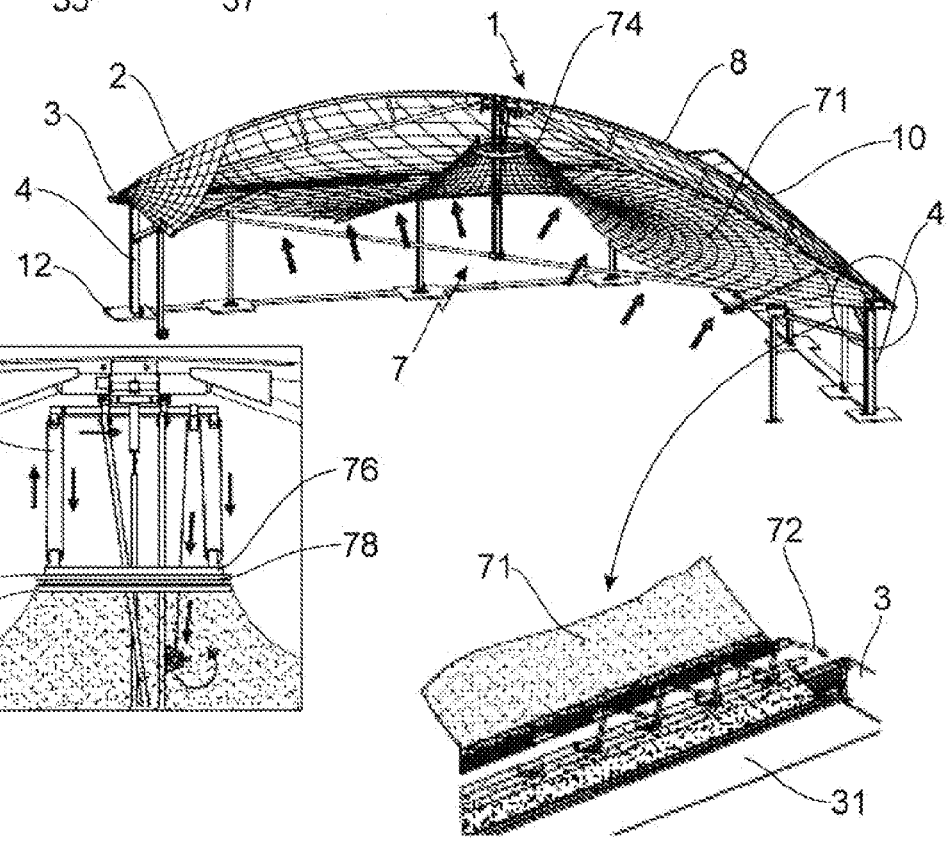
Figure 11:
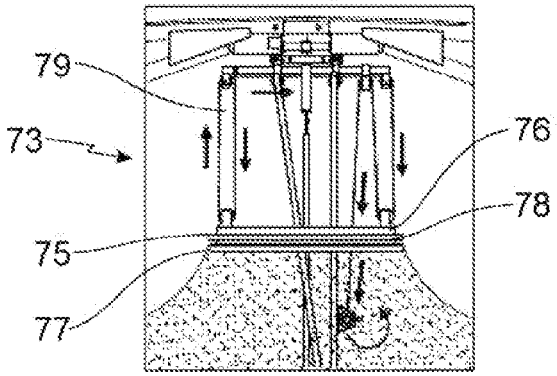
Figure 12:
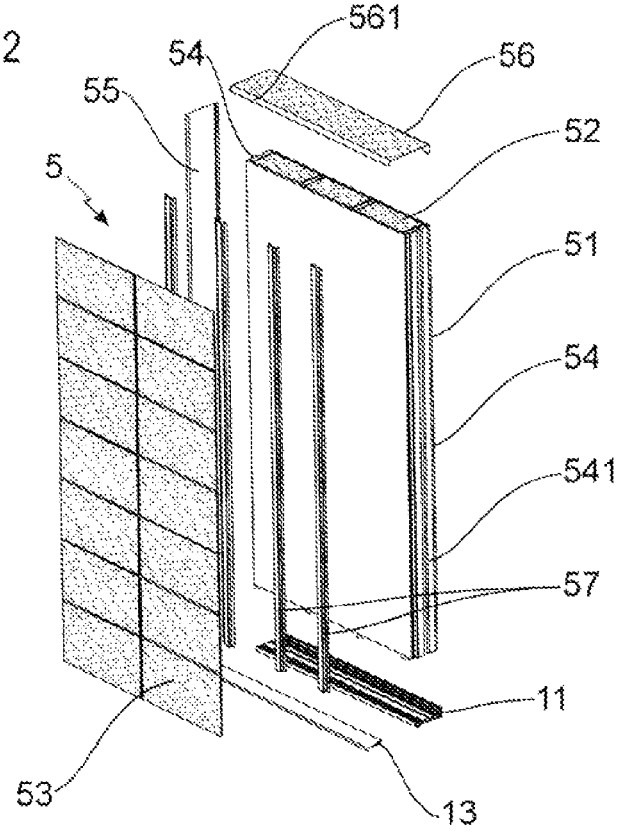
Figure 13:
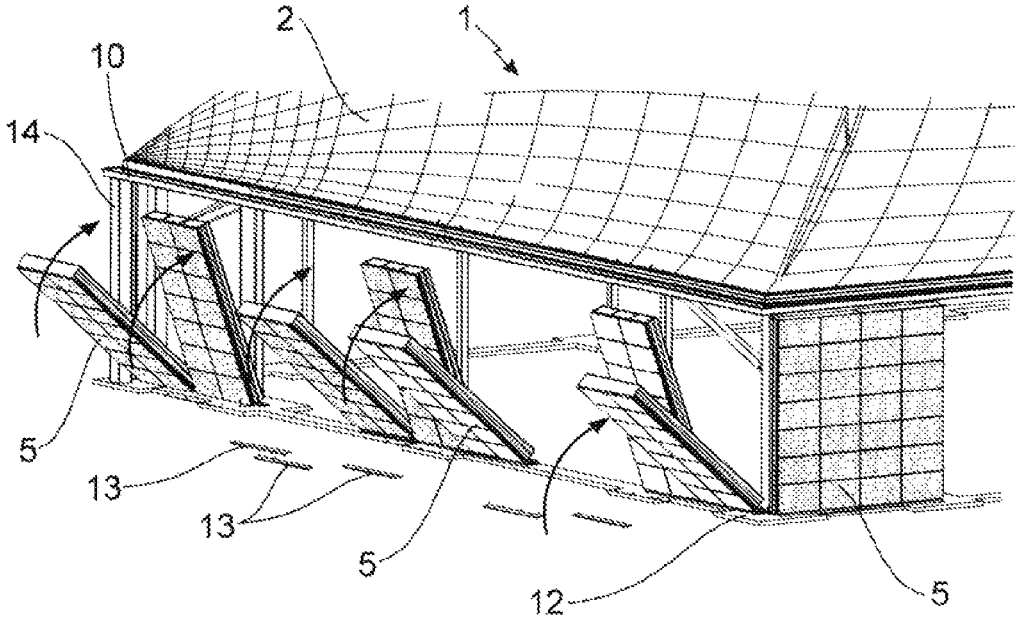
Figure 14:
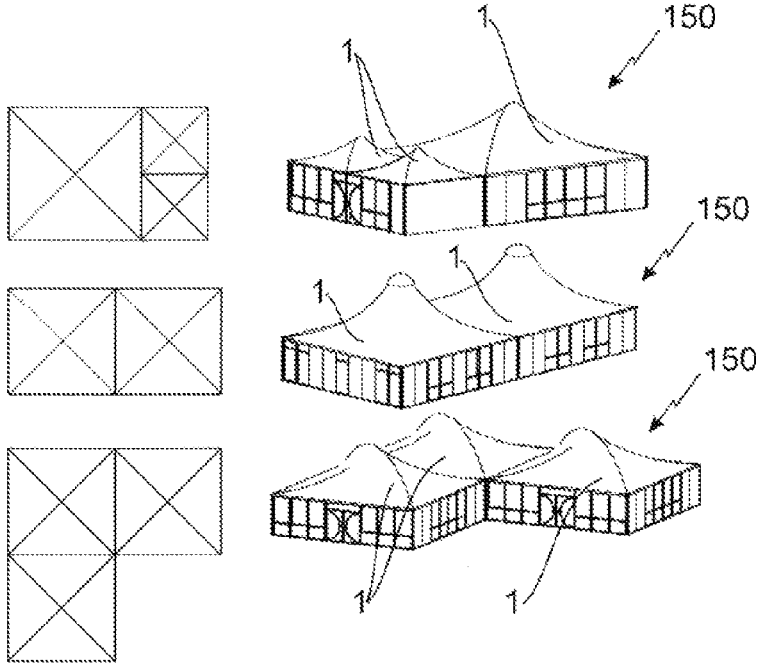
Figure 15:
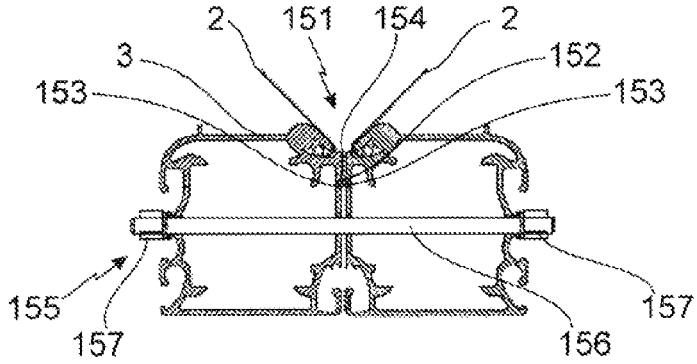
Figure 16:
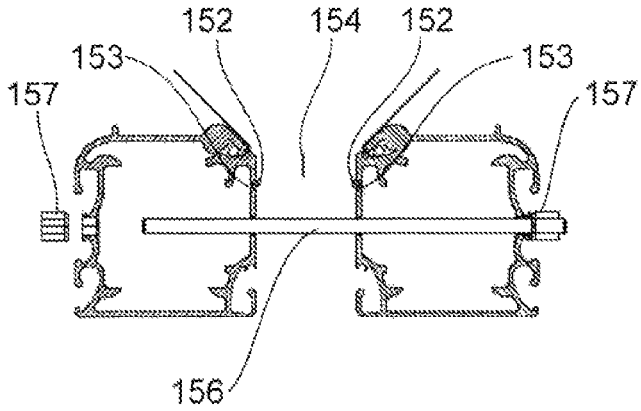

FIGS. 8*a* to 8*d* are perspective views of the rigid frame of a lightweight housing module according to the invention in the process of being raised, at different stages of this raising;

FIG. 9 is a perspective view of the rigid frame of a lightweight housing module according to the invention provided with gutters and a detailed view showing the method of fastening of said gutters;

FIG. 10 is a perspective partial view of a lightweight housing module according to the invention with an alternative of a false ceiling in the process of being mounted;

FIG. 11 is a partial detailed view of the means of connecting the false ceiling according to FIG. 10 in the process of being mounted;

FIG. 12 is an exploded perspective view of an alternative of vertical panels of the lightweight housing module according to the invention;

FIG. 13 is a perspective view of the lightweight housing module according to the invention with the vertical walls in the process of being mounted;

FIG. 14 is a series of perspective and top views of various configurations of a modular building according to the invention;

FIG. 15 is a vertical cross-section of the assembly of two lightweight housing modules according to the invention constituting a modular building according to the invention;

FIG. 16 is an exploded vertical cross-section of the assembly of two lightweight housing modules according to the invention constituting a modular building according to the invention.

BEST MANNER OF CARRYING OUT THE TECHNICAL INVENTION

As such in reference to FIGS. 1 to 13, the lightweight housing module 1 comprises a stretched fabric 2 intended to form the roof of said lightweight housing module 1 and fixed along its lower peripheral edge on a rigid frame 3 maintained at a distance from the ground by a plurality of lateral posts 4 which in turn are fixed on the ground.

Furthermore, the lightweight housing module 1 further comprises vertical panels 5 and/or opening frames 6 in order to close in a substantially sealed manner the vertical facades located along the perimeter of the frame 3, said opening frames 6 being more preferably standard off-the-shelf elements of the door, French window, single or double window type or sliding bay windows, the panels 5 being carried out with off-the-shelf materials such as metal sheets, rough or reconstituted lumber and/or insulation materials such as mineral wool for example.

Finally, the lightweight housing module 1 comprises a false ceiling 7 arranged under the fabric 2 inside said lightweight housing module 1 and fixed by its peripheral edge along the frame 3.

In order to obtain the stretching of the fabric 2, the lightweight housing module 1 comprises a system for stretching (see FIG. 4) comprising a framework 8 formed by at least one arch subdivided into two semi-arches 81 of which the lower ends each press against the frame 3, and of which the upper ends 82 are connected to one another by a system for separating 83 such as that described in European patent application EP 2 130 994 filed in the name of the applicant. The separation between the upper ends 82 causes an upward displacement of the median portion of the arch and therefore a stretching of the fabric 2 since its lower edge is fixed on the frame 3.

This system for separating 83 (see FIG. 5) comprises means of connecting of the type by sliding press-fitting a tube 84 inside at least one of the upper ends 82 of the semi-arches 81, and means for separating said upper ends 82 comprising engaging members 85 respectively integral with one and the other of the upper ends 82 and a threaded member 86 cooperating with said engaging members 85 for the purpose of bringing closer and/or inversely separating said ends 82 from one another. The threaded member 86 is constituted of a threaded rod provided in its median zone with a member for maneuvering 87 in rotation and, at its ends, with threadings in the opposite direction of rotation. The engaging members 85 are made integral with the exterior of said upper ends 82 and comprise interior threadings cooperating respectively with the corresponding threadings of the threaded rod.

The frame 3 comprises more preferably spars 31 joined and fixed together by means not shown on the drawing, each of the spars 31 being constituted of a profiled element made of light alloy, of solid or hollow substantially rectangular straight section. The frame 3 comprises means of fastening (not shown) able to receive the posts 4 and the structural reinforcements such as, for example, struts 9, and comprises means of fastening (not shown) allowing for their respective fastening on said frame 3.

Moreover, the frame 3 comprises a system for fastening 32 able to provide the fastening of the lower peripheral edge of the fabric 2 on said frame 3. To do this, the system for fastening 32 is advantageously similar to that described in European patent EP 0 277 073 delivered in the name of the applicant.

As such, the system for fastening 32 (see FIG. 7) is such that each of the spars 31 of the frame 3 have a groove 33 exiting via an inlet slot of a width less than that of the bottom of the groove 33 and a lock ring 34 can be engaged transversally in the groove 33, through its inlet slot, and be immobilized therein in order to retain therein the lower peripheral edge of the fabric 2 having a bead 21. The system for fastening 32 is remarkable in that in locking position the lock ring 34 is in vertical position, at a right angle in relation to its introduction position via an inlet slot, and it is wedged inside the groove 33, in such a way that a traction force exerted towards the exterior, on the fabric 2, does not allow the bead 21 to escape from the groove 33.

Conventionally, the lightweight housing module 1 comprises at least partially along the periphery of the frame 3 a plurality of gutter elements 10 (see FIG. 9), integral with said frame 3, making it possible to collect the rain water streaming on the fabric 2, said gutter elements 10 being integral with the frame 3.

To do this, the frame 3 comprises more preferably, in accordance with French patent FR 2 684 712 delivered in the name of the applicant, a longitudinal groove 35 (see FIG. 9) in the general shape of a C opening towards the exterior, of which the upper portion comprises a protuberance 36 directed downwards, while the lower portion comprises a protuberance 37, of substantially greater dimensions, directed upwards, these protuberances 36, 37 delimiting the opening of the groove 35. This groove 35 is intended to receive, via snap-fitting, the gutter element 10, of which the straight section is generally in the shape of a U and of which the internal wall 101 located on the side of the frame 3 is separated in the upper portion into two branches, i.e. an external branch 102, located in the extension of the internal lateral wall 101 and an internal branch 103, having a transversal section of a substantially circular shape, of which the concavity is turned towards the exterior of the gutter element 10, and of which the end is located above that of the external branch 102. The ends of the two external and internal branches 102, 103 are elbowed respectively downwards and upwards, in such a way that in the hollows of the respective elbows formed as such can be housed the respective protuberances 36, 37. The two external and internal branches 102, 103 are elastically deformable under the effect of a solicitation, in such a way as to allow for the snap-fitting of the gutter element 10 in the groove 35 of the spar 31.

Moreover, in order to reduce the dimensions of the section of the profiled elements and therefore their weight and their cost, the spars 31, in particular those of great length, comprise a means of pre-stressing 38 (see FIG. 6) making it possible to place each spar 31 in a stretched state, said stretching is opposite to that which will be exerted by the fabric 2 when the latter is stretched. As such, this means of pre-stressing 38 is positioned in the vicinity of the middle of each spar 31 and comprises, more preferably, a cable 381 of which the length is substantially longer than that of said spar 31 and of which the ends are fixed respectively in the vicinity of the ends of said spar 31, and an extendible stressing member 382 extending globally perpendicularly to the spar 31 and able to receive the cable 381 and to stretch it by increasing its length, such as the cord of an arc whereon one pulls radially in relation to the sleeve of the arc. This operation will tend to push the middle of the spar 31 back towards the exterior of the frame 3 and make it possible to resist the stretching of the fabric 2 which on the contrary has for effect to return said middle of the spar 31 towards the interior of the frame 3.

For this, the stressing member 382 is inclined in such a way as to be substantially parallel to the stretched fabric 2 and comprises a tube 383 integral with the spar 31 and comprising at its free end a threading (not shown), a threaded rod 384 able to be displaced in the tube 383 by cooperating with said threading, a receiving member 385 in the general shape of a U, fixed to the free end of said threaded rod 384 and able to receive the cable 381, and a member for blocking 386, advantageously a nut, making it possible to immobilize the threaded rod 384 in relation to tube 383.

For reasons of thermal and sound insulation, the lightweight housing module 1 comprises at least partially along the periphery of the frame 3, vertical panels 5 in order to close the vertical facades located under said frame 3.

In a preferred embodiment, each of these panels 5 (see FIG. 12) comprises a plate 51 advantageously composed of two walls sandwiching at least one batt insulation 52 made of insulation material such as mineral wool or polystyrene for example, a baseboard 53 arranged on said plate 51 on the exterior side of the lightweight housing module 1. Each panel 5 is closed vertically by two boards 54 arranged between the walls of the plate 51 along each of its vertical edges and provided with at least one female groove 541 opening to the exterior of said plate 51 and able to cooperate with a batten (not shown) in order to allow for the vertical assembly and the seal between two adjacent panels. The walls of the plate 51, the boards 54 and the battens will be more preferably carried out using rough or reconstituted lumber.

Panels 5 can be conceived with a board 54 provided with at least one female groove 541 and a board (not shown) provided with at least one male groove (not shown), said female groove 541 and said male groove being able to cooperate respectively with at least one female groove 541 of an adjacent panel 5 in order to allow for their vertical assembly doing without battens, without leaving the scope of this invention. Likewise, there can be two types of panels 5, one with solely male grooves and one with solely female grooves 541 and panels 5 of each of the two types will be assembled consecutively and alternatively.

The seal between a unit, comprising either one panel 5 or several adjacent panels assembled together, and the frame and posts 3, 4 of the lightweight housing module 1 is carried out (see FIG. 12) using first vertical sealing profiles 55 in the general shape of a U arranged on each side of said unit and a second sealing horizontal profile 56 in the general shape of a U arranged at the top of said unit, the first and second profiles 55, 56 providing the seal by preventing in particular rain water infiltration. To do this, the second profile 56 is integral with the frame 3 of the lightweight housing module 1 and is wider than the panel 5 and has its external wing 561 inclined in relation to the vertical towards the exterior of the lightweight housing module 1 in order to act as a rain barrier and prevent rain water from being introduced between said second profile 56 and the top of the panel 5.

The first and second profiles 55, 56 are advantageously made of metal and fixed in the plate 51 and baseboard 53 unit by screws not shown.

The baseboard 53 can be fixed directly on the plate 51 or with an offset thanks to the spacing profiles 57 that have a straight section in the general shape of a capital omega, in such a way as to leave an air space between the baseboard 53 and the plate 51 in order to increase the insulation of the panel 5.

Constituted as such, the panels 5 are arranged under the frame 3 pressing against a rail 11 (see FIG. 12) more preferably an extruded profile made of light alloy fixed to the ground, of which the straight section is in the general shape of an L, said rail 11 providing the seal between the panels 5 and the ground while preventing the panels 5 from directly resting on the ground in order to prevent them from becoming degraded. In addition, the rail 11 makes it possible to guarantee the horizontality and the continuity of the installation plane of the panels 5.

However, in a preferred embodiment, the lightweight housing module 1 will furthermore be based on a bricked enclosure 12 guaranteeing a continuous installation plane that is clean and substantially horizontal.

The opening frames 6, which are standard off-the-shelf products in the construction sector, are inserted and fixed between the panels 5 by conventional techniques used in said sector.

In order to perfect the seal and the esthetics of the lightweight housing module 1, said module 1 comprises profiles 13, of which the straight section is in the general shape of an L, around opening frames 6 and along rails 11.

Likewise, in order to perfect the seal and the esthetics of the angles of the lightweight housing module 1, said module 1 further comprises cladding corner profiles 14 able to cooperate with the panels 5 arranged on either side of a corner post 4 and to mask said post 4 by surrounding it.

Finally, the lightweight housing module 1 further comprises a false ceiling 7 (see FIG. 10). In a preferred embodiment, the false ceiling 7 is, in reference to FIG. 10, a fabric 71 stretched inside the lightweight housing module 1 under the fabric 2 forming the roof of said lightweight housing module 1 and fixed by its peripheral edge along the frame 3.

To do this, the exterior peripheral edge of the fabric 71 of the false ceiling 7 has a bead (not shown) arranged in order to be retained in a system for fastening (not shown) of the fabric 71 in the frame 3 of the lightweight housing module 1. Said system for fastening is advantageously similar to that described in European patent EP 0 277 073 delivered in the name of the applicant.

However, in order to overcome the possible defects concerning dimensions and/or positioning, said fabric 71 advantageously comprises a compensation zone able to absorb said defects thanks to a string 72 more preferably elastic (see the detail of FIG. 10). Said compensation zone is a peripheral cut-out in the fabric 71 of the false ceiling 7 separating the latter into a first central zone and a second end zone comprising the bead. The string 72 then connects in an adjustable manner the first and second zones (not shown).

In a manner that is analogous to the means of connection described in European patent application EP 1 905 926 filed in the name of the applicant, the false ceiling 7 comprises means of connecting 73 in order to maintain in a stretched position the fabric 71 in relation to the framework 8 of the lightweight housing module 1.

As such, the fabric 71 further comprises in its central portion an orifice 74 provided with a ring 75, i.e. a bead. This ring 75 is formed by a ring taken in a fold of said fabric 71, said ring being for example made of cord, natural or synthetic.

The means of connecting 73 comprise a segment 76, i.e. an annular portion, intended to receive on its exterior face the ring 75 of the fabric 71. This segment 76 is provided at its base with a stop 77 extending radially towards the exterior, for example fixed to the segment 76 by welding, and a locking ring 78 which, in the position where the false ceiling 7 is mounted (as shown in FIG. 10), is interposed between the ring 75 and the stop 77, as such providing the blocking of the ring 75.

The false ceiling 7 further comprises connecting members 79 of the means of connecting 73, and in particular of the segment 76, to each of the upper ends of the semi-arches 81 of the framework 8 of the lightweight housing module 1. These connecting members 79 provide the maintaining in suspended position of the fabric 71 of the false ceiling 7. For this, said connecting members 79 are advantageously of the pulley-cable type, in such a way that by pulling on a cable the unit (segment 76-ring 75-locking ring 78) is brought closer to the upper ends 82 of the semi-arches 81 in order to raise it and to stretch the fabric 71.

In light of the preceding, the false ceiling 7 is with a double inverted curvature, i.e. it has the general shape of a Chinese hat, in other terms a tapered surface of revolution of which the cone distance is not a straight line but a curve.

For more details concerning the false ceiling 7, reference will be made to a patent application filed concomitantly in the name of the applicant.

The false ceiling 7 has for effect, on the one hand, to reduce the volume to be heated by decreasing the ceiling height and, on the other hand, to create a "heat cushion" by imprisoning the air contained in the entire portion of the lightweight housing module 1 located above the frame 3 between the fabrics 2 and 71. It is understood that by reducing the volume to be heated, the operating cost in particular in terms of heating will be reduced significantly.

However, in order to increase the thermal performance of the false ceiling 7 and therefore of the lightweight housing module 1, the false ceiling 7 can comprise at least one batt insulation (not shown) arranged by the orifice 74 (see FIG. 10) above the fabric 71 and constituted of insulation materials such as mineral wool or polystyrene for example in the form of plates or rolls to be unwound. These insulation materials are introduced via the orifice 74 after the stretching of the fabric 71 then deposited onto said fabric 71.

The orifice 74 also makes it possible to check from the interior the state of the fabric 2 forming the roof of the lightweight housing module 1, but also the state of the framework 8 of the system for stretching said fabric 2.

In order to perfect the esthetics and the insulation of the false ceiling 7, the orifice 74 will be advantageously closed by a cap (not shown).

Those skilled in the art will have no difficulty in dimensioning the various elements that comprise the lightweight housing module 1 according to the invention according to the overall dimensions of said lightweight housing module 1 and to the conditions of the site where the latter will be installed. Likewise, in order to provide for the stability of the lightweight housing module 1, those skilled in the art will have no difficulty in determining the strengthening elements required such that, for example, additional lateral posts, struts, bracings, diagonals connecting two opposite angles of the frame 3 or bars maintaining the framework 8 in place.

Figure 1:
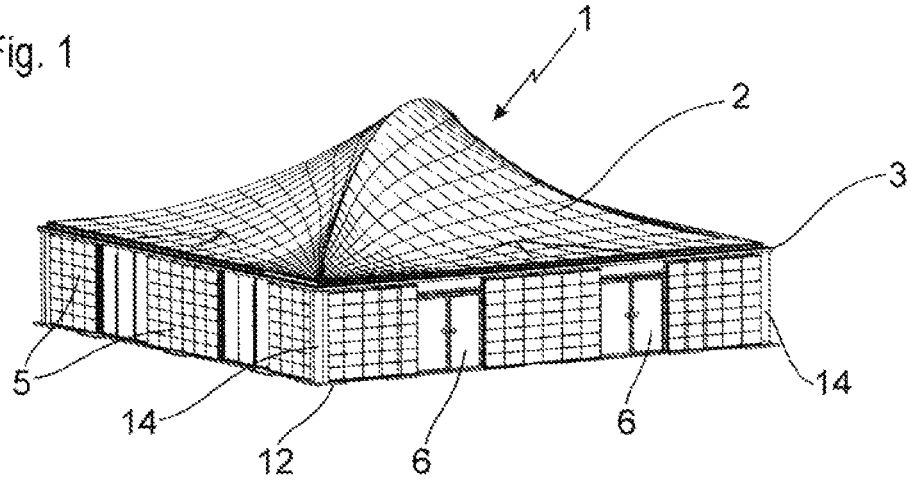
FIG. 1 is a perspective view of a lightweight housing module according to the invention.
Figure 2:
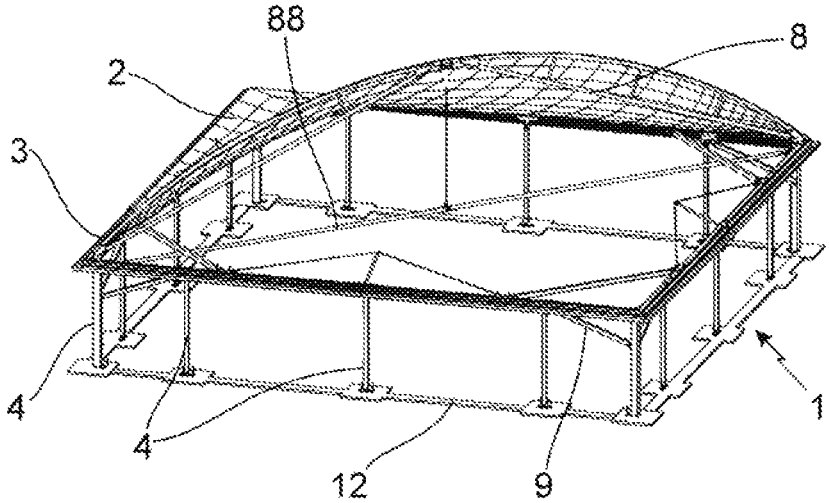
FIG. 2 is a partial perspective view of a lightweight housing module without its vertical walls.
Figure 3:
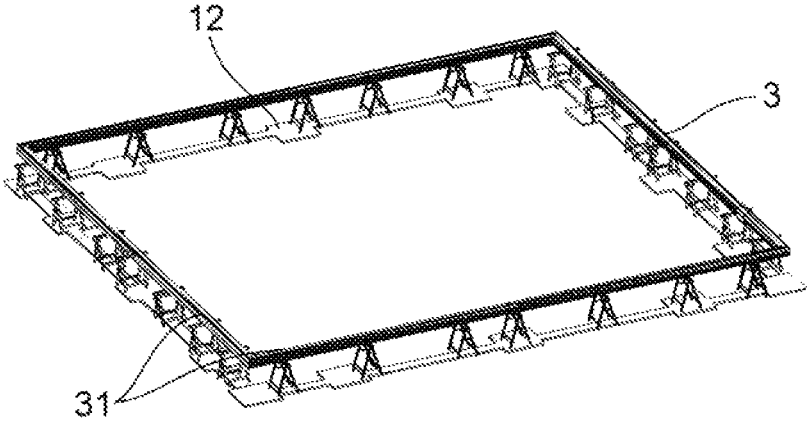
FIG. 3 is a perspective view of the rigid frame of a lightweight housing module according to the invention in the process of being mounted on the ground.
Figure 4:
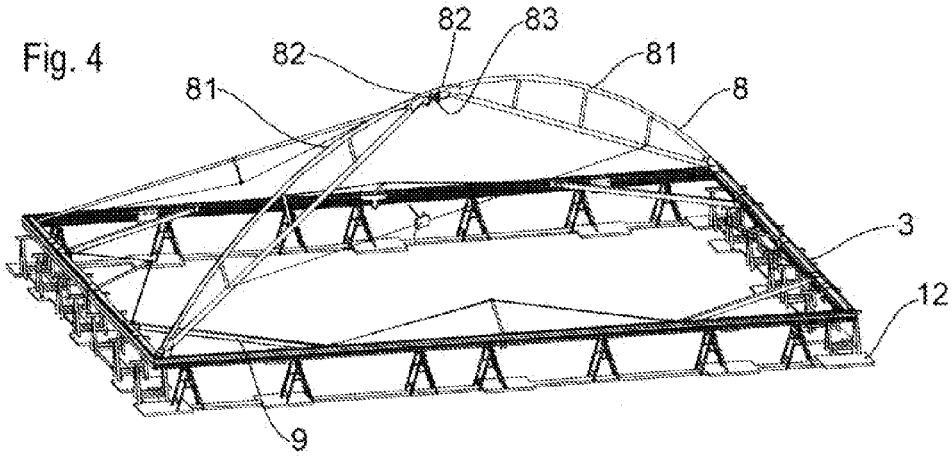
FIG. 4 is a perspective view of the rigid frame of a lightweight housing module according to the invention provided with an alternative of a device for stretching fabric in the process of being mounted.
Figure 6:
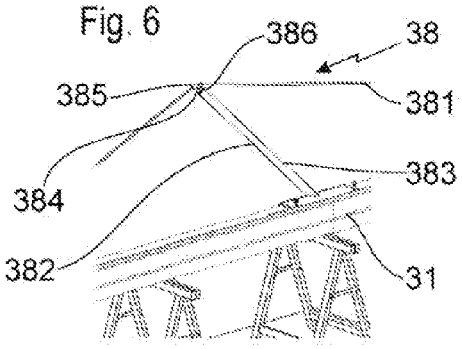
FIG. 6 is a detailed perspective view of the rigid frame of a means of pre-stressing of a lightweight housing module according to the invention.
Figure 5:
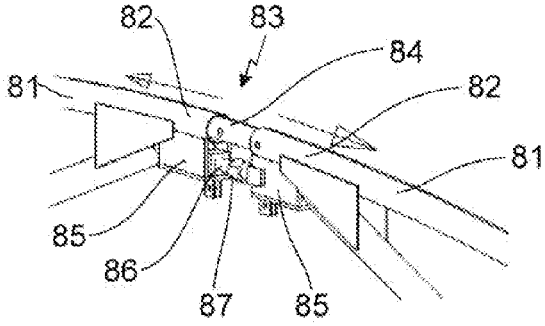
FIG. 5 is a detailed perspective view of the rigid frame of an alternative of the device for stretching fabric of a lightweight housing module according to the invention.
Figure 7:
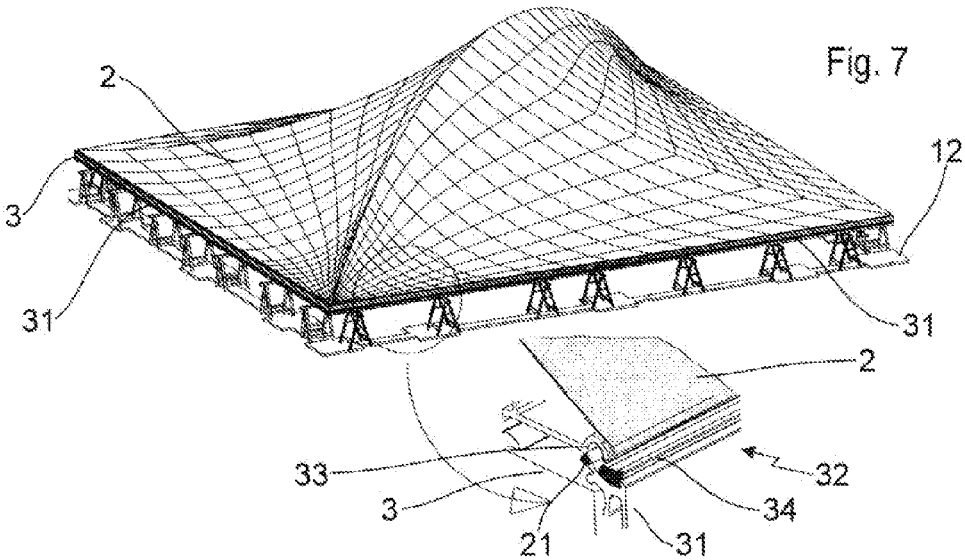
FIG. 7 is a perspective view of the rigid frame of a lightweight housing module according to the invention covered with the fabric and a detailed view showing the system for fastening said fabric.
Figure 8A:
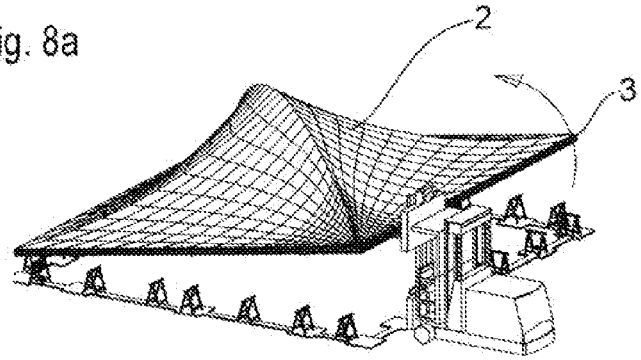
Figure 8B:
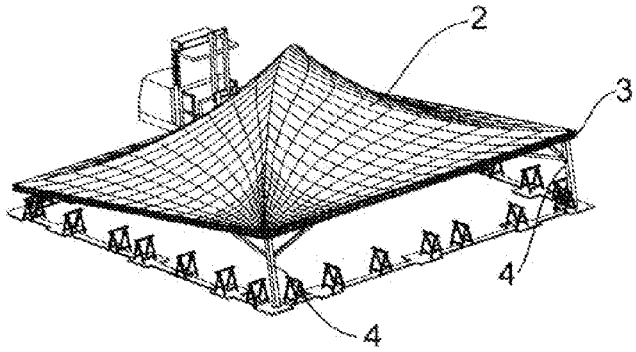
Figure 8C:
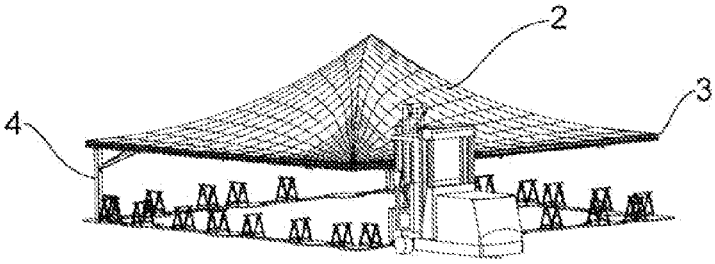
Figure 8D:
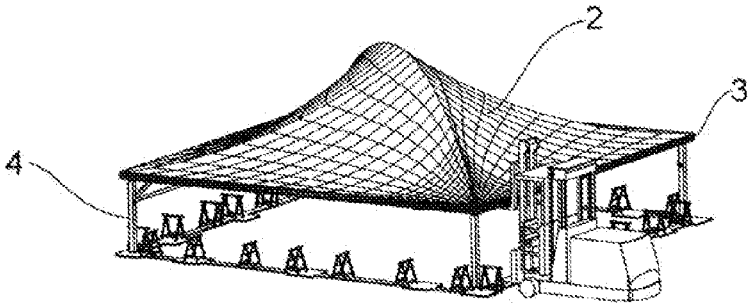

As such, in reference to FIGS. 2 and 4, when, in order to obtain the stretching of the fabric 2, the lightweight housing module 1 comprises a system for stretching comprising a framework 8 formed by at least one arch subdivided into two semi-arches 81 of which the lower ends each press against the frame 3, the lightweight housing module 1 further comprises a diagonal tension element 88 connecting two opposite angles of the frame 3 and arranged in the vertical plane containing the two semi-arches 81. This diagonal tension element 88 makes it possible to maintain the mechanical balance of the unit after the stretching of the fabric 2. According to the dimensions of said lightweight housing module 1, the diagonal tension element 88 is advantageously a cable or a bar.

In reference to FIGS. 1 to 13, the invention also has for purpose a method of assembly of the lightweight housing module 1 comprising a plurality of steps, i.e.:

- assembly of the frame 3,
- setting up the system for stretching the fabric 2 forming the roof of the lightweight housing module 1,
- fastening of the lower peripheral edge of the fabric 2 on the frame 3,
- stretching of the fabric 2 thanks to its system for stretching,
- setting up the lateral posts 4 providing the maintaining of the frame 3 at a distance from the ground,
- setting up of the false ceiling 7,
- setting up of the vertical facades comprising in particular lateral panels 5 and/or opening frames 6.

It is understood that these steps may not be carried out in the order indicated. For example, the setting up of the posts 4 can be carried out before setting up the system for stretching the fabric 2 and the step of setting up the vertical facades can precede the step of fastening the peripheral edge of the fabric 71 forming the false ceiling 7.

The step of assembly of the frame 3 of the lightweight housing module 1 according to the invention can be preceded by a step of carrying out a bricked enclosure 12 forming a continuous installation plane of said lightweight housing module 1.

Likewise, the step of setting up the vertical facades can advantageously be followed by a step of setting up a plurality of gutter elements 10 then a step of controlling the finishings and the seal of the lightweight housing module 1 with where applicable a fire hose test for example.

The step of assembly of the frame 3 of the lightweight housing module 1 according to the invention as well as those for setting up and stretching the fabric 2 will be more preferably, for obvious reasons of facility, carried out on the ground or at the height of a man, on trestles, for example.

In reference to FIGS. 8*a* to 8*d*, the step of setting up the posts 4 is accomplished progressively by raising them on one side then on another side in order to progressively set up the posts 4 one after the other.

It is understood, according to the preceding description, that the mounting of the lightweight housing module 1 is very simplified and requires very little equipment and tools.

In reference to FIGS. 14 to 16, the invention also relates to a modular building 150 constituted of a plurality of lightweight housing modules 1, whether or not of different dimensions, arranged next to each other.

FIG. 14 shows several non-restricted examples of the layout of modular building 150.

In order to obtain said modular building 150, as described above, each of the lightweight housing modules 1 constituting said building 150 must be assembled until the setting up of the vertical facades comprising in particular lateral panels 5 and/or opening frames 6. Indeed, the modular building 150 is not just a simple juxtaposition of closed lightweight housing modules 1 but that a person living in said building must be able to go back and forth between a lightweight housing module 1 and the other. For this, the vertical faces of a lightweight housing module 1 located across from an adjacent lightweight housing module 1 must be at least partially open, which requires to provide the seal between the various lightweight housing modules 1 comprising said modular building 150.

For this, in reference to FIGS. 15 and 16, the modular building 150 comprises a system for sealing 151 between the faces across from the frames 3 of two adjacent lightweight housing modules 1.

The system for sealing 151 comprises a first sealing member 152 arranged in a longitudinal groove 153 made in the frame 3 of each of the lightweight housing modules 1, a second member for sealing 154 arranged above the first sealing member 152 between the frames 3 of two adjacent lightweight housing modules 1, and a plurality of clamping member 155 intended to provide the clamping of the two frames 3 against one another and the compression of the first and second sealing members 152, 154 in order to provide the seal between two adjacent lightweight housing modules 1.

The first and second sealing members 152, 154 are more preferably closed-cell seals made of EPDM for example and respectively of the lip seal and flat seal type.

The clamping members 155 advantageously comprise a threaded rod 156 simultaneously passing through the two frames 3 and comprising at each of their ends a nut 157 allowing for the clamping of said two frames 3 against one another.

In order to recover the rain water, the modular building 150 comprises gutter elements (not shown) fixed, as described above for the gutter elements 10 of a lightweight housing module 1, along the perimeter of said modular building 150.

Finally, the invention also has for purpose the method of assembly of the modular building 150 according to the invention comprising a plurality of steps, i.e.:

- mounting of the various lightweight housing modules 1 constituting the modular building 150,
- setting up of the system for sealing 151 between the faces across from the frames 3 of two adjacent lightweight housing modules 1.

The step of mounting various lightweight housing modules 1 comprising the modular building 150, according to the invention, can be preceded by a step of carrying out a bricked enclosure 12 forming a continuous installation plane of said modular building 150.

DESCRIPTION OF OTHER EMBODIMENTS

In an alternative embodiment not shown, the lightweight housing module 1 according to the invention can include a system for stretching the fabric 2 intended to form the roof of said lightweight housing module 1 comprising a central mast.

As such, the central mast of the lightweight housing module 1 can be of the type of that described in French patent application FR 10/00127 filed in the name of the applicant. Said central mast, which carries, at its upper end, the central portion of the fabric 2 fixed along its lower edge to the frame 3, is articulated in order to facilitate placing it in a vertical position and extensible in order to stretch said fabric 2 by pushing the central portion of the fabric 2 upwards.

In another alternative embodiment not shown, the false ceiling comprises either removable slabs suspended from a profile grid advantageously made of light alloy, or a flexible sheet, generally opaque, deformed by stretching so that its edges, provided with means of anchoring, can be fixed to anchoring rails fixed on the face of the frame 3 of the lightweight housing module 1.

In another alternative embodiment not shown, the panels 5 are of the self-supporting sandwich panel type, factory prefabricated, designed to nest into one another in such a way as to guarantee a solid and sealed assembly between them. These panels 5 can for example be of the type of those proposed by the TRIMO (Registered trademark) company.

POSSIBILITY FOR INDUSTRIAL APPLICATION

The lightweight housing module 1 according to the invention and the modular building 150 constituted of a plurality of lightweight housing modules 1 can advantageously be installed on any type of site regardless of the climatic and access conditions. Furthermore, the description clearly shows that the lightweight housing module 1 and the modular building 150 according to the invention allow for simple and rapid construction, while guaranteeing high-performance sound as well as heat insulation and therefore a reduced operating cost.

Finally, it is obvious that the examples of lightweight housing module 1 and of modular building 150 in accordance with the invention which have just been described are only particular illustrations, in no case restrictive of the invention.

The invention claimed is:

1. A lightweight housing module comprising:

- a plurality of lateral posts intended to be fixed to the ground;
- a rigid frame having a perimeter maintained a distance from the ground by said plurality of lateral posts;
- a plurality of vertical facades formed along said perimeter of said rigid frame, wherein said plurality of facades are formed from a plurality of at least one of vertical panels or vertical open framing for receiving vertical panels providing a closed in and sealed interior of said lightweight housing module;
- at least one stretched fabric having a lower peripheral edge, said at least one stretched fabric fixed to said rigid frame along said lower peripheral edge, wherein said at least one stretched fabric is intended to form a roof of said lightweight housing module;
- a false ceiling comprising a false ceiling fabric having a double inverted curvature arranged under said at least one stretched fabric inside of said lightweight housing module, said false ceiling having a peripheral edge, said peripheral edge being fixed to said rigid frame in such a way as to create a heat and sound cushion comprising a layer of air contained between said at least one stretched fabric and said false ceiling fabric, said false ceiling fabric further having an orifice in a central portion thereof, said orifice being provided with at least one ring for enabling the false ceiling fabric to maintain in a suspended position; and
- a system for stretching said at least one stretched fabric, said system being arranged entirely inside of said lightweight housing module, said system stretching said at least one stretched fabric by pushing said fabric upwards.

2. The lightweight housing module according to claim 1, wherein the plurality of vertical panels are heat insulation panels.

3. The lightweight housing module according to claim 2, wherein the plurality of vertical panels comprise:

- at least one plate composed of two walls sandwiching at least one batt insulation;
- a baseboard integral with said at least one plate on an exterior side of the lightweight housing module; and
- two boards arranged between the walls of said plate along each vertical edge of said plate.

4. The lightweight housing module according to claim 1, further comprising first sealing vertical profiles in a general shape of a U arranged on each side of a unit of at least one of said plurality of vertical panels and a second sealing horizontal profile in a general shape of a U arranged at a top of said unit, the first and second profiles providing a seal between said unit and the rigid frame and said plurality of lateral posts of the lightweight housing module.

5. The lightweight housing module according to claim 1, wherein the plurality of vertical panels are arranged under the rigid frame pressing against a rail fixed to the ground, said rail providing a seal between the plurality of vertical panels and the ground.

6. The lightweight housing module according to claim 1, wherein the false ceiling comprises means of connecting and connecting members configured to maintain said false ceiling fabric in a suspended position in relation to the lightweight housing module.

7. The lightweight housing module according to claim 6, wherein the means of connecting comprise:

a segment intended to receive the at least one ring, the segment being provided at a base thereof with a stop; and a locking ring intended to be interposed between the at least one ring and the stop thereby providing a blocking of the at least one ring on the segment.

8. The lightweight housing module according to claim 7, wherein the connecting members are pulley-cable type connecting members.

9. The lightweight housing module according to claim 6, wherein the connecting members are pulley-cable type connecting members.

10. The lightweight housing module according to claim 6, wherein the false ceiling fabric is provided with a string in such a way that said false ceiling fabric is fixed on the rigid frame in an adjustable manner.

11. The lightweight housing module according to claim 1, wherein the false ceiling comprises at least one batt insulation arranged above the false ceiling fabric.

12. The lightweight housing module according to claim 1, wherein the false ceiling comprises a flexible sheet deformed by stretching, and edges of said flexible sheet are provided with means of anchoring in order to be fastened to anchoring rails fixed on the rigid frame of the lightweight housing module.

13. The lightweight housing module according to claim 12, further comprising a system for fastening able to provide a fastening of the lower peripheral edge of the stretched fabric on said rigid frame.

14. The lightweight housing module according to claim 13, wherein the system for fastening is such that the rigid frame has a groove exiting via an inlet slot of a width less than that of a bottom of the groove and that a lock ring can be engaged transversally in the groove, through the inlet slot of the groove, and be immobilized therein in order to retain therein the lower peripheral edge of the stretched fabric having a bead, in such a way that in a locking position the lock ring is wedged inside the groove and that a traction force exerted towards an exterior on the stretched fabric does not allow said bead to escape from the groove.

15. The lightweight housing module according to claim 1, wherein the system for stretching the at least one stretched fabric comprises a framework formed by at least one arch subdivided into two semi-arches of which lower ends of said arch are each pressed against the rigid frame, and of which upper ends of said arch are connected to one another via a system for separating, a separation of the upper ends causing an upward displacement of a median portion of said arch and therefore a stretching of the at least one stretched fabric.

16. The lightweight housing module according to claim 15, wherein the system for stretching the at least one stretched fabric is associated with a diagonal tension element connecting two opposite angles of the rigid frame and arranged in a vertical plane containing the two semi-arches.

17. The lightweight housing module according to claim 1, wherein the system for stretching the at least one stretched fabric comprises a central mast carrying, at an upper end thereof, a central portion of the at least one stretched fabric fixed along the lower edge of the at least one stretched fabric to the rigid frame; and wherein the central mast is articulated to facilitate putting the central mast into vertical position and extensible in order to stretch the at least one stretched fabric by pushing said central portion of the at least one stretched fabric upwards.

18. The lightweight housing module according to claim 1, wherein the rigid frame comprises spars.

19. The lightweight housing module according to claim 18, wherein the spars each comprise a means of pre-stressing.

20. The lightweight housing module according to claim 19, wherein the means of pre-stressing is positioned in a vicinity of a middle of each spar and comprises a cable and a stressing member extensible and able to receive the cable.

21. The lightweight housing module according to claim 20, wherein the stressing member extends perpendicularly to the spars and is inclined in such a way as to be substantially parallel to the at least one stretched fabric of the lightweight housing module.

22. The lightweight housing module according to claim 1, further comprising at least partially along a periphery of the rigid frame a plurality of gutter elements being integral with the rigid frame.

23. The lightweight housing module according to claim 22, wherein the rigid frame comprises a longitudinal groove intended to receive, via snap-fitting, the plurality of gutter elements.

24. A modular building comprising a plurality of the lightweight housing modules according to claim 1, arranged next to one another, and a system for sealing provided between faces across from the rigid frames of two adjacent lightweight housing modules, said system for sealing providing a seal of a unit of said modular building.

* * * * *